United States Patent [19]

Fleck

[11] 4,380,720

[45] Apr. 19, 1983

[54] APPARATUS FOR PRODUCING A DIRECTED FLOW OF A GASEOUS MEDIUM UTILIZING THE ELECTRIC WIND PRINCIPLE

[76] Inventor: Carl M. Fleck, Schelleingasse 14, 1040 Wien, Austria

[21] Appl. No.: 208,417

[22] Filed: Nov. 19, 1980

[30] Foreign Application Priority Data

| | | | |
|---|---|---|---|
| Nov. 20, 1979 | [AT] | Austria | 7384/79 |
| May 6, 1980 | [AT] | Austria | 2397/80 |
| May 6, 1980 | [AT] | Austria | 2398/80 |
| Jul. 23, 1980 | [AT] | Austria | 3806/80 |
| Jul. 23, 1980 | [AT] | Austria | 3808/80 |

[51] Int. Cl.[3] ..... H01J 7/24

[52] U.S. Cl. ..... 315/111.91; 250/281; 250/423 R; 313/619; 315/111.81

[58] Field of Search ..... 261/DIG. 42; 313/182, 313/189; 315/111.8, 111.3, 111.9; 250/281, 282, 423

[56] References Cited

U.S. PATENT DOCUMENTS

| | | | |
|---|---|---|---|
| 2,279,586 | 4/1942 | Bennett | 315/111.91 |
| 2,285,622 | 6/1942 | Slepian | 315/111.91 |
| 2,765,975 | 10/1956 | Lindenblad | 315/111.91 |
| 2,794,118 | 5/1957 | Kiriloff et al. | 315/111.91 |
| 3,280,365 | 10/1966 | Young | 315/111.91 |
| 3,411,035 | 11/1968 | Necker | 315/111.91 |

FOREIGN PATENT DOCUMENTS

| | | |
|---|---|---|
| 913172 | 12/1962 | United Kingdom . |
| 2016305 | 9/1979 | United Kingdom . |

OTHER PUBLICATIONS

Applied Electronics by Truman Gray (#2 Edition), pp. 148–161; Jul. 16, 1954.

*Primary Examiner*—Harold A. Dixon

*Attorney, Agent, or Firm*—Karl F. Ross; Herbert Dubno

[57] ABSTRACT

An electric-wind or static-breeze generating system in which ions are produced in a duct and drift toward a counterelectrode thereby displacing a gas, e.g. air, through the duct at atmospheric pressure. Nozzles can introduce an aerosol to increase the air displacement and an alternating current system can be utilized to energize the device in a bipolar manner.

16 Claims, 13 Drawing Figures

APPARATUS FOR PRODUCING A DIRECTED FLOW OF A GASEOUS MEDIUM UTILIZING THE ELECTRIC WIND PRINCIPLE

FIELD OF THE INVENTION

The present invention relates to a method of and to an apparatus for producing a directed flow of a gaseous medium, e.g. an air stream utilizing the electric wind or static breeze principle. More particularly the invention relates to an apparatus for the bulk displacement of a gas, especially air, by electric field forces without moving parts.

BACKGROUND OF THE INVENTION

For the displacement of air at standard, ambient or normal atmospheric pressure, mechanical means are practically exclusively used today although a number of physical phenomena are known to be effective in the displacement of gases.

For example, it is known to pump gases by adsorption processes, by cooling and heating processes, by diffusion processes and by the use of electric fields or charges in a so-called electric wind or static breeze processes or in accordance with the principles thereof (see Bergmann-Schaefer, Vol. 2, pp. 10–474). At atmospheric pressures, however, these processes have found little utility to date and the concentration has been upon the use of mechanical blowers with impellers or rotors or on the use of water jet pumps.

For higher pressures, both rotary and linearly reciprocating mechanical devices may be used and for reduced pressures the concentration is upon the use of adsorption pumps of various constructions, ion-getter pumps, diffusion pumps, cryopumps and the like. Electric wind has also been utilized at reduced pressures, generally in the range between so-called pre-vacuums and high vacuums for gas transport as described, for example, in German Pat. No. 265,534.

In general, the mechanical systems used at atmospheric pressure or above for the displacement of air are noisy and of low energy efficiency while the techniques utilized for the displacement of gas at low pressures have seldom been considered effective at atmospheric pressure or for the high volume displacement of gases such as air.

OBJECTS OF THE INVENTION

It is the principal object of the present invention to provide a method of displacing air which allows the utilization of the electric wind principle or static breeze principle at higher pressures than those with which electric wind systems have hitherto been contemplated, e.g. normal atmospheric pressures, for the efficient displacement of air or other gases.

Another object of this invention is to provide an apparatus operating under electric wind principles but which can be used for the displacement of gases at atmospheric pressure and has comparatively high energy efficiency while being free from the disadvantages of earlier gas displacement systems.

SUMMARY OF THE INVENTION

These objects and others which will become apparent hereinafter are attained, in accordance with the present invention, which is based upon the discovery that electric wind or static breeze can be effective even at atmospheric pressures for energy-efficient gas transport.

According to the invention, ions are formed by an electrode in a high electric field, for example a wire which is operated in the region of a Townsend discharge or glow discharge, the discharge current being preferably between $10^{-5}$ A/cm sq. and $10^{-3}$ A/cm sq., a flow passage, preferably formed by at least one conductive surface of a counterelectrode, being provided such that the edges of the conductive surfaces are parallel to the discharge electrode wire so that the ions move in a direction of the counterelectrode at least in a sector of an imaginary sphere surrounding the emission point of the discharge electrode with an aperture or generating angle of less than 180°.

When the field strength on the wire is dimensioned such that only a Townsend or glow discharge is formed, the anode currents are between $10^{-6}$ A/cm sq. and $10^{-1}$ A/cm sq. When minimal noise evolution is required for the air pumping processes and ozone generation is to be minimized or excluded, the discharge current is held between $10^{-5}$ A/cm sq. and $10^{-3}$ A/cm sq.

Surprisingly, under these conditions, the bulk displacement of air at atmospheric pressure can be generated with high efficiency since the ion movement direction coincides with the direction of movement of the air entrained thereby and turbulence is excluded. In mechanical blowers, of course, such turbulence cannot be excluded even at low impeller velocities.

Experimental investigation has shown that an ion blower in accordance with the present invention can displace approximately 1 liter of air per second with an energy input of 1 watt as long as excessively high air velocities and pressure differentials are not required.

According to a feature of the invention, the side turned away from the discharge electrode of the counterelectrode is juxtaposed with an auxiliary electrode which is held in the region of the potential of the discharge electrodes. The ions are generated by the discharge electrode which is preferably a wire held at high potential and drift toward the counterelectrode which can be grounded and which can consist of one or more air-guide plates whose edges are parallel to the discharge wire while the auxiliary electrode can also comprise a guide plate with edges parallel to the discharge wire.

The blower effect produced by the ion drift results from an internal friction of the ions within the gas such that the ions entrain a sufficient number of air molecules in an electrically induced movement to establish a bulk flow of air in the direction of the ion drift or movement.

When this process is analyzed it is found that the initial friction is between the ions and the gas molecules and thereafter water molecules in the gas are entrained. According to a further feature of the invention through one or more nozzles at high potential, a liquid aerosol of unipolar charged droplets (volatile or nonvolatile) can be formed in the gas which is displaced in the manner described over a stretch or path downstream of the aerosol-generating region.

The geometry of the nozzle and any counterelectrode provided for the formation of the unipolar aerosol is such, in accordance with the invention, that the aerosol forms or tends to form a cone with an apex angle less than 90° operating in the direction of the displacement stretch, this being assured by controlling the voltage level at the nozzles or the charging electrode and by grounding an appropriate counterelectrode.

The length of the aerosol path can be at least 20 to 30 mm with a potential difference thereacross of 10 to 30 kv, preferably 15 to 25 kv, for the generation of a comparatively large flow in the direction of the counterelectrode by entrainment with the aerosol.

When the liquid to be atomized in forming the aerosol is conductive and/or it is desirable on other grounds to apply a high potential to the nozzle or nozzles, it is possible in accordance with the present invention, to operate the nozzle or nozzles at ground potential and to bring the counterelectrode to the high potential.

The power consumption of an aerosol blower according to the invention will depend upon the energy required for producing a stream of droplets subjected to the high voltage field and hence for producing the requisite number of ions which, by adsorption or other pick-up are collected by each droplet in the formation of the electroaerosol, thereby bringing about complete charging of the droplets and a maximum air entrainment with the electrically displaced droplets of the aerosol.

The invention is applicable to the displacement in air in filter devices for household use and, in this embodiment of the invention, the apparatus should comprise an ionization part and, downstream thereof, a collector part. The ionization part comprises at least the discharge electrode means, preferably a plurality of discharge electrodes, most advantageously in the form of thin wires of a corresponding high potential, and counter-electrodes which in general can be at the ground potential and thus define with the discharge electrodes the electric field imparting a drift to the ions formed at the discharge electrodes in the downstream direction.

Depending upon the polarity of the discharge electrodes a pluarlity of electrically conductive mutually parallel plates which can be alternately of high potential and ground potential so that electric fields are established between each pair of plates of different potentials so that dust particles which are charged can be attracted to one of the plates of each pair and collected thereon.

The disadvantage of such an air filter apparatus which may result from the fact that the various components require different potentials can be obviated by appropriate selection of a transformer and a rectifier system. For example, the discharge electrodes, generally in the form of wires, require a potential between 12 and 15 kv while the collector plate voltages may be between 3 and 6 kv. Since the 6 kv of the collector plates are only required when the 12 kv are applied to the ionization zone, a 6 kv transformer may be used in accordance with the present invention together with two diodes connected in a voltage doubling circuit. Thus, a single transformer with a peak-to-peak voltage of 6 kv can suffice to supply both the ionization potential and the collector potentials. Of course, collector plates which are at a voltage of 6 kv require effective electrical insulation and must be spaced apart by relatively large distances to prevent electrical break-down. This can increase the cost of the unit and the space required.

It has been found that separate ionization of the collectable electrodes in an air filter according to the invention may not be necessary, i.e. a separate electrical source or the aforementioned transformer need not be connected to the collectable electrodes, the latter need not be insulated with expensive high voltage insulation and the spacing between the plates need not be as great as the case when the plates are separately energized. More particularly it has been found that the intermediate collector plates can be positioned between and insulated from the other collector plates so that the plates develop appropriate collector charges in the field.

The best results are obtained for the movement of gases, by the generation of positive ions. However, there is a significant disadvantage when positive ions are released by any electrically operated unit and this applies to systems of the present invention and to prior art electrostatic devices which have a tendency to charge the air with positive ions or reduce the level of negatively charged particles. In practice it is found that negatively charged particles tend to be preferentially captured by collector plates.

The emission of positively charged particles and the predominance of positive ions in an air stream has been found to have biological effects upon animal life and people. For example, in addition to causing discomfort, headaches and other disorders and leading to a general reduction in the resistance to colds and microbial infections, similar to those which are attributed to weather inversions and hot winds and like atmospheric influences, the high positive ion contact of an air stream has been associated with a level of disquiet and discomfort which is both annoying and capable of preventing people from being able to concentrate or work properly.

To overcome this disadvantage, the invention provides an apparatus capable of enriching the air with negative ion or charged particles, i.e. raising the level of such negative charged particles in displaced air above the level characterizing earlier electrostatic devices such as electrostatic filters.

To this end, ground collector plates are provided with recesses or channels in which are disposed thin wires which are at ground potential but lie parallel to portions of collector plates overhanging these cutouts and at high positive potential.

This construction appears to give rise to a discharge which increases the concentration of negative particles or ions in a gas stream.

While the apparatus described previously, utilizing unipolar charging of ions and their entrainment of air, for air displacement over mechanical blowers and the like, has significant advantages as previously pointed out, it has been found that it is possible to eliminate the high cost of generating the high direct-current potentials by substituting therefor under certain conditions a high voltage alternating current.

Thus, according to another aspect of the invention, an apparatus for producing a direct stream of a gaseous medium, e.g. air by electrostatic forces which operate upon gas ions, comprises the counterelectrode, discharge electrode and preferably also an auxiliary electrode in the manner originally described and means for applying a high-voltage alternating current to those electrodes which are spaced apart in the flow direction. The flow velocity of the gas or drift velocity of the ions in the gas at a given alternating-current frequency and the distance between charging counterelectrodes for a given frequency are established in a predetermined relationship. More particularly, the smaller of these velocities is greater or equal to a coefficient times the product of the frequency and spacing.

The apparatus of the present invention can thus be operated with a high voltage alternating current and ions of either charge can be utilized to generate the blower effect mentioned previously.

In a preferred embodiment of the invention, a plurality of ion blower stages are provided in a succession in a flow passage without spacing of the electrodes and establishment of the velocities stepped so as to provide a resonance effect to increase blower output or produce a greater blower pressure differential.

BRIEF DESCRIPTION OF THE DRAWING

The above and other objects, features and advantages of the present invention will become more readily apparent from the following description, reference to be made to the accompanying drawing in which.

SPECIFIC DESCRIPTION

Figure 1:
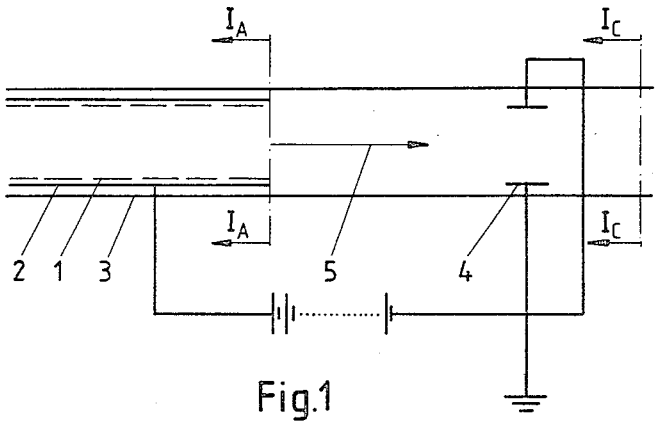
FIG. 1 is a diagrammatic axial section illustrating an electric wind apparatus for displacing air in accordance with the principles of this invention.
Figure 1A:
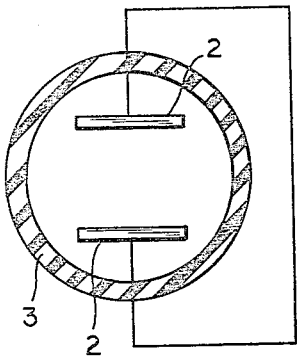
FIG. 1A is a diagrammatic section along the line IA—IA of FIG. 1.
Figure 1B:
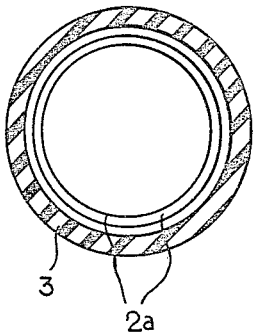
FIG. 1B is a section corresponding to FIG. 1A but illustrating another embodiment.
Figure 1C:
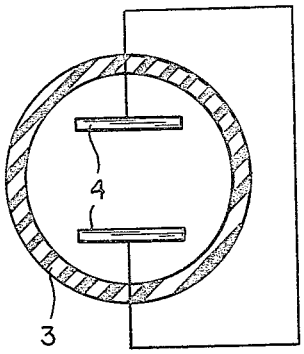
FIG. 1C is a diagrammatic section taken along line IC—IC of FIG. 1.
Figure 1D:
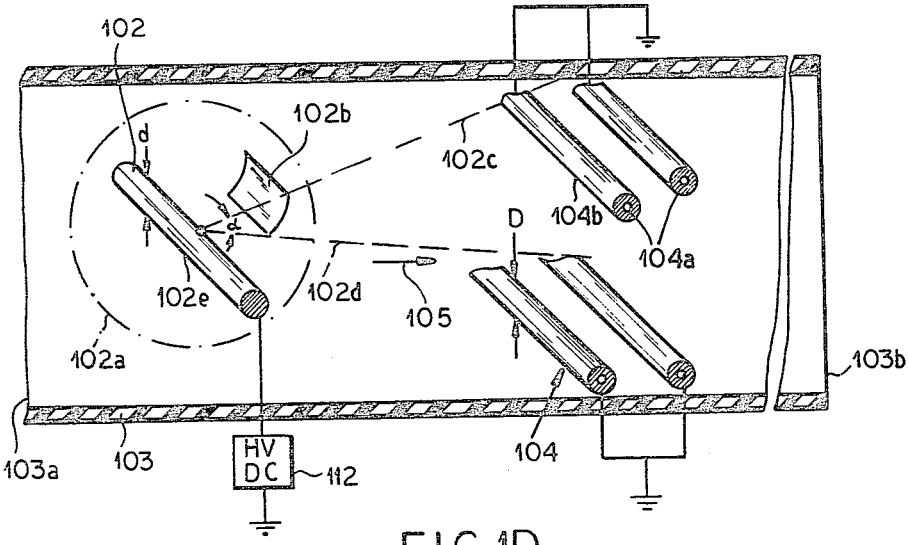
FIG. 1D is a diagram illustrating a feature of the invention as applied to a wire ionizing electrode and a counterelectrode consisting of a group of electrode wires.

Referring first to FIG. 1D, it can be seen that within a conduit represented at 103 open at one end 103*a* to a supply of air and open at the opposite end 103*b* to a region to be supplied with air, there is provided a discharge wire electrode 102 which is maintained at glow discharge potential, i.e. a Townsend discharge potential, by a high voltage direct current power supply 112.

Downstream of the discharge wire in the direction of arrow 105, there is provided a counterelectrode means 104 which, in this embodiment, comprises two planar arrays of wires 104*a* at ground potential. Each point along the discharge wire 102 thus functions as an emission point for ions which at least in a sector 102*b* of the imaginary sphere 102*a* around this point define an angular aperture $\alpha$ for the ions which is less than 180° and preferably even less than 90°, i.e. substantially all of the ions produced by the field between the electrode 102 and the counterelectrode means 104 is concentrated in the region defined between the limbs 102*c* and 102*d*, defining the angle $\alpha$. The electrode 2 is operated such that the discharge current is between $10^{-5}$ A/cm$^2$ and $10^{-3}$ A/cm$^2$ while the edges of the counterelectrode means 104, represented by the generatrices 104*b* are parallel to the generatrices or edges 102*e* of the wire 102. This ensures that the ions are emitted and moved in a direction or at least a sector having the aperture angle less than 180° previously mentioned.

Naturally, other means can be provided with an equivalent purpose.

For example in FIG. 1 the ions are generated within the guide tube 3 for the gaseous stream by a radioactive alpha particle emitter, e.g. tritium, a composition of which is applied as represented at 1 on the discharge electrode 2. The unipolarity is assured by the discharge electrode 2 which can be a pair of plates as shown in FIG. 1A or a tube 2*a* as indicated in FIG. 1B.

The plate pair 2 is spaced from a preferably ground ring- or plate-shaped counter electrode 4 defining a directed field with field lines which generally extend in the direction of arrow 5 and along which the unipolar gas ions drift and entrain neutral gas molecules by reason of molecular impact also in the direction of this arrow so that, macroscopically, a bulk movement of gas occurs in the field direction.

As can be seen in FIG. 1D, moreover, the diameter d of the electrode 102 is less than the diameter D of the electrodes 104*a*, the latter electrodes being cooled, e.g. by the circulation of liquid through them so as to have a lower temperature than that of the electrode 102.

Figure 2:
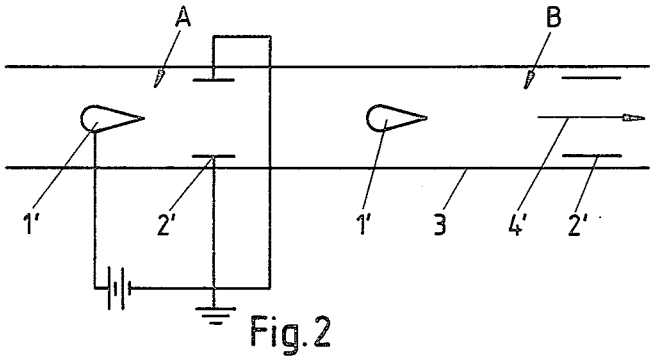
FIG. 2 is a diagrammatic view similar to FIG. 1 illustrating a series arrangement of discharge electrode and counterelectrode whereby the output of the device can be increased utilizing a plurality of stages.

In FIG. 2 the ions are generated by point discharge electrodes 1' at a high potential such that only electrodes of the same polarity are injected into the gas stream. The electrode points 1' are so formed that the field lines extend generally from left to right in the direction of the annular counterelectrodes 2', thereby causing a displacement of air within the insulated tube 3 in the direction of arrow 4'. In the embodiment shown two stages A and B are provided in succession or cascade to increase the pressure differential which can be generated between the inlet and outlet size of the tube 3 by the electric wind.

Figure 3:
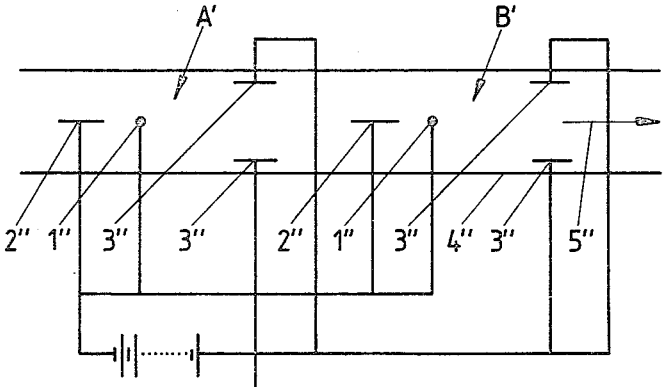
FIG. 3 is a similar view of another embodiment of the invention using a plurality of stages in series.

In the embodiment of FIG. 3 a similar arrangement has been shown in which the discharge wires 1'' cooperate with auxiliary electrode 2'' of the same voltage and potential to ensure that the field lines extend to the two pairs of ground plates 3'' associated with the electrode 1' of each stage, two stages A' and B' being provided in succession. The auxiliary electrodes 2'' of each stage serve to collect oppositely charged ions which might migrate in the direction opposite the ion drift direction 5' within the tube 4''.

The embodiments of FIGS. 1 through 3 and 1D can be used as room ventilators and can be provided as the charging stages of air filters which can have collectors as subsequently described formed downstream of the charging stages.

Figure 4:
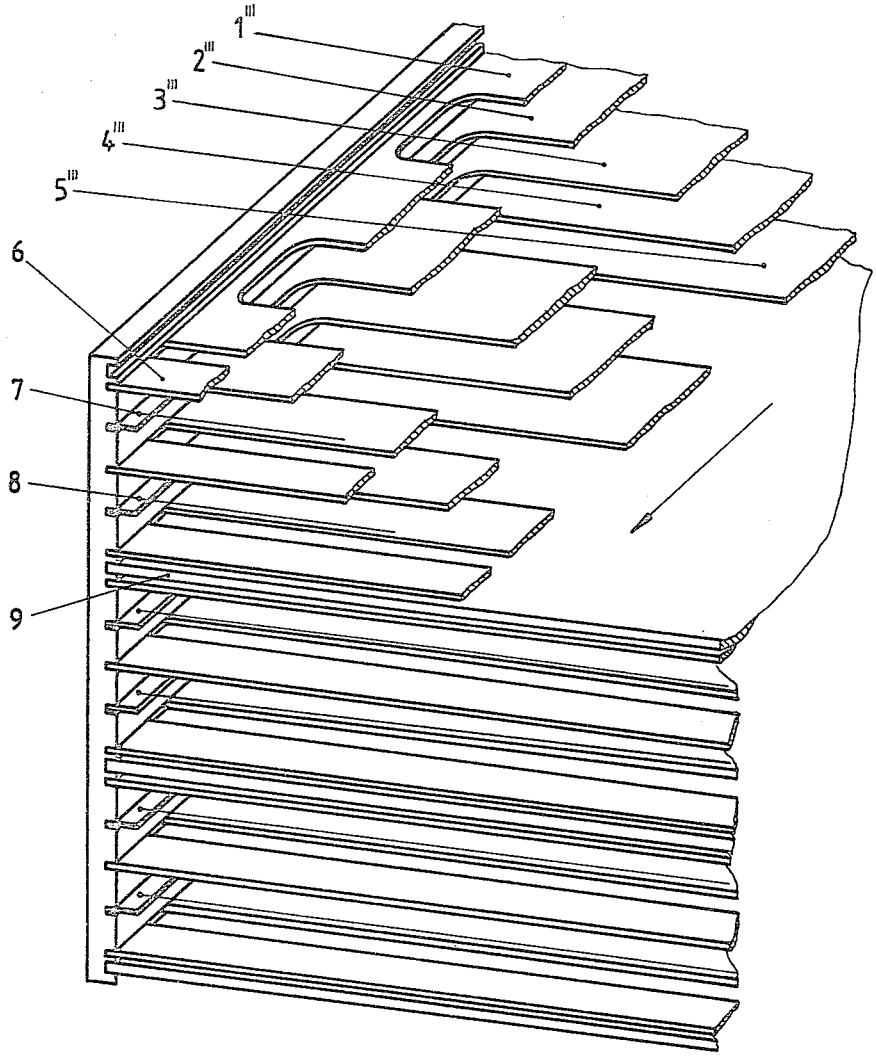
FIG. 4 is a fragmentary perspective view, partly broken away, showing an embodiment utilizing discharge stages in a cascade and adjacent one another.

FIG. 4 illustrates diagrammatically a pratical embodiment of the ion-drift blower utilizing the principles of the blower of FIG. 3.

In this embodiment the ion-drift paths are disposed in a plurality of superposed planes.

The grounded counterelectrodes 1''' and the auxiliary electrodes 2''' can be stamped from sheet metal and discharge electrodes can be in the form of wires which are stretched across the paths and are held with spot welds 7 to the auxiliary electrodes.

The assembly thus comprises the successive layers 3''', 4''', 5''', 8 disposed one below the other.

A terminal or final electrode 6 along each path controls the quantity of residual ions which can emerge from the blower in the direction of the arrow.

An insulating partition 9 enables the assembly to be subdivided into two blowers for displacing air with ions of different polarities, thereby precluding static charging of the pumped gas and fault currents in the supply network.

Figure 5:
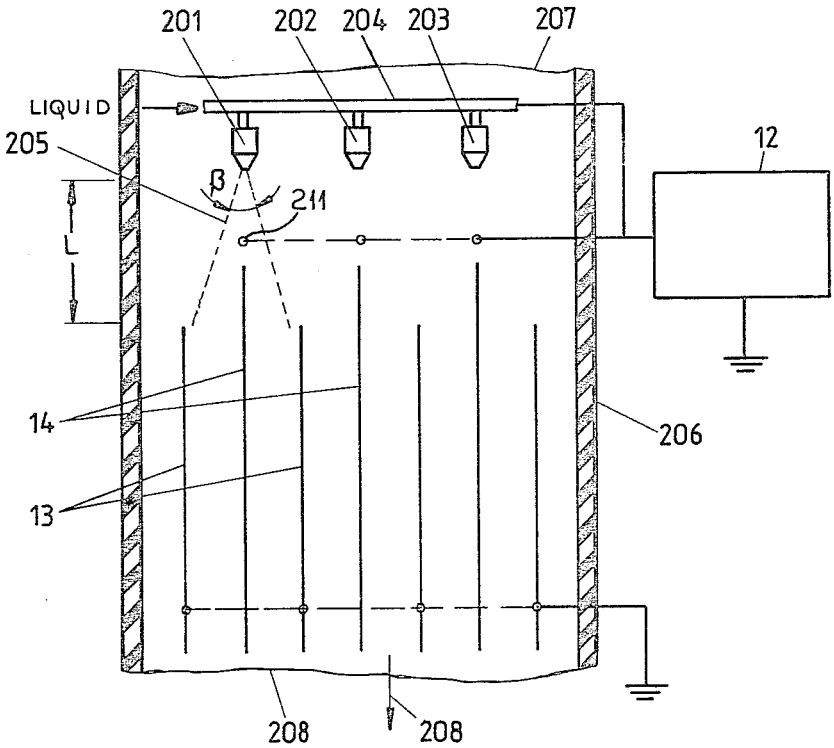
FIG. 5 is a diagram illustrating a circuit arrangement in accordance with an embodiment of the invention.

FIG. 5 shows, in highly diagrammatic form, a section in which the ion-producing discharge wires 11 are connected to a high voltage source 12 which can be, for example, at a potentional of 12 kV. The downwardly flowing air stream passes between the grounded plates 13 which are insulated from collector plates 14 which pick up the aerosol, dust particles and excess ions and which are at an induced potential of about 3 kV, the collector plates 14 alternating with the grounded counterelectrode plates 13.

Figure 6:
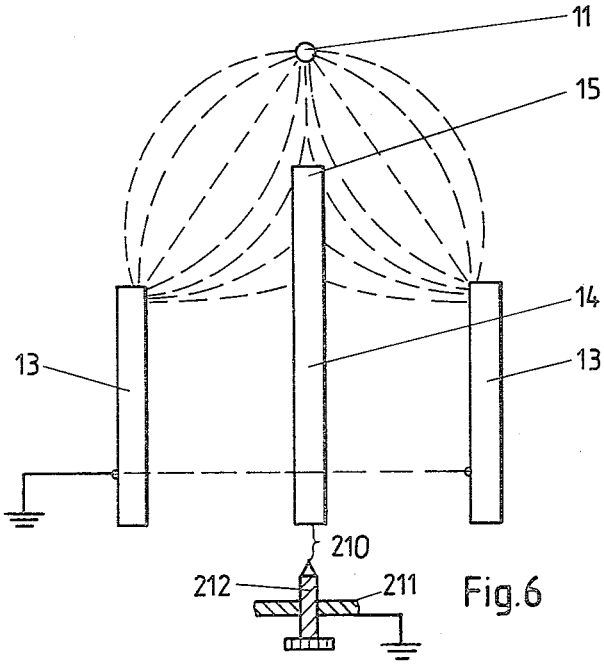
FIG. 6 is a detailed view of a portion of the system of FIG. 5 but showing electric field lines.

The field relationship is better seen in FIG. 6 which represents the field lines in broken line form running from the discharge wire 11 to the grounded plates 13 and intercepted by the insulated plates 14 which are not directly connected to the supply circuitry. The latter term is used to describe not only the supply 12 but also ground and any direct electrical connection with the supply 12 or the ground.

Since the end 15 of the plate 14 projects beyond the corresponding edges of the plates 13 into the field lines, a lower potential is induced on plate 14 than appears at discharge electrode 11, although the potential on plate 14 is higher than that which appears on plates 13, i.e. ground potential.

Thus any charged particle between the plates 13 and 14 will be attracted, depending upon its polarity, to one of these plates or the other.

Since the potential on plates 14 will depend upon the potential at the point 15 in the electric field, by selection of the spacing of the plate 14 from the wire 11, the plate voltage can be readily selected to lie practically anywhere within the range of 2 kV to 10 kV.

When the system of FIGS. 5 and 6 is utilized as an electrostatic air filter, it can also function as a wet filter into which a liquid aerosol is fed. For example, an array of nozzles 201–203 can be provided upstream of the electrodes 11 and can be connected to the same potential as these electrodes and, via a pipe 204 to a source of liquid, e.g. water, at high pressure to generate atomized sprays as represented by the broken lines 205 in FIG. 5, the spray cone having an apex angle $\beta$ which is preferably less than 90°. The length of the path L between the nozzles 201 and the counterelectrodes 13 should be at least 20 to 30 mm and the potential difference between the nozzles 201–203 and the plates 13 should be between 10 and 30 kV, preferably 15 to 25 kV. The air flow duct is here represented at 206 and has an inlet side 207 and an outlet side 208.

The filter of FIG. 5 thus can operate as a wet electrofilter in which the ions are picked up by the aerosol droplets and electrically charge these droplets so that the bulk movement of air in the direction of arrow 208 through the filter is improved.

When the plates 14 are to operate at a potential of about 2 kV or below, additional voltage stabilization can be obtained by providing a spark gap 210 between the plate 14 and ground, e.g. by connecting threaded conductive member 211 to ground and adjusting a conductive screw 212.

The principles of the invention are also applicable to potential symmetry or mirroring, thereby enabling the discharge electrodes to be at ground potential while the field is generated by maintaining the separator plates which form or contain the counterelectrodes at the high potential.

To provide the desired high field strength at the discharge electrodes, the latter should be of relatively small area confronting the counterelectrodes, i.e. in the form of wire, points or the like. In this case, the ions are of the opposite polarity and the intermediate plates 14 should have potentials adjusted accordingly to permit the above-described collection operation to be effective.

Figure 7:
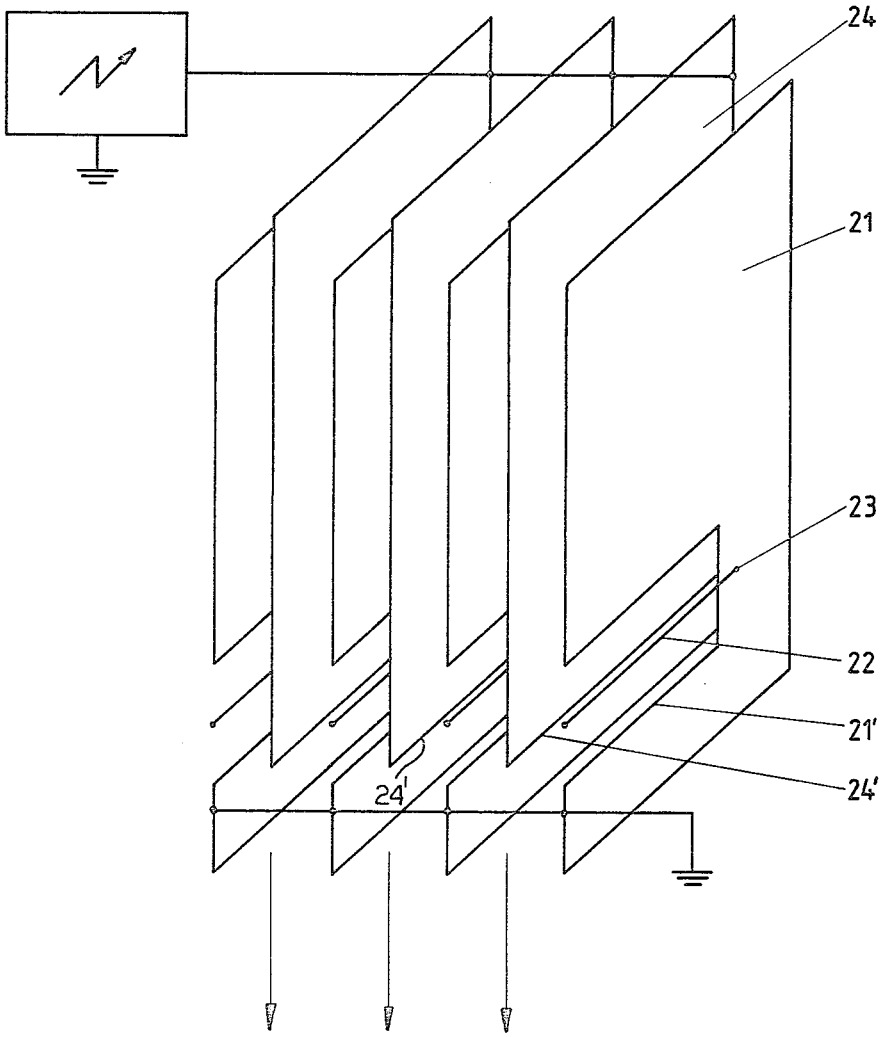
FIG. 7 is a perspective view of a portion of an air filter embodying the invention.

FIG. 7 shows a system in which the grounded collector plates 21 are formed with cutouts 21' spanned by wires 22 which are spot-welded at 23 to the plates and thus are also at ground potential. The wires 22 thus lie parallel to and are juxtaposed with the collector plates 24 which are at high potential.

The electric fields around the wires 22 are the same whether the wires are of negative high potential and juxtaposed with grounded plates or are grounded and juxtaposed with plates of high positive potential. In both cases, the wires 22 generate negative ions at the downstream sides of the collector plates to introduce such negative ions into the air stream entering the room. Preferably, the wires 22 are juxtaposed with the edges of the plates 24, i.e. the plates 24 terminate at the same level as the wires 22. In FIG. 7, the ionization part of the apparatus has not been illustrated.

The quantity of negative ions thus introduced into the air entering the room can be controlled either by varying the wire diameter or the width of the cutout, or both. It is also possible to control the proportion of ions introduced into the air stream by varying the position of the edge 24' of each collector plate 24 with respect to the wires. Preferably the wires are thin, high-potential wires.

Figure 8:
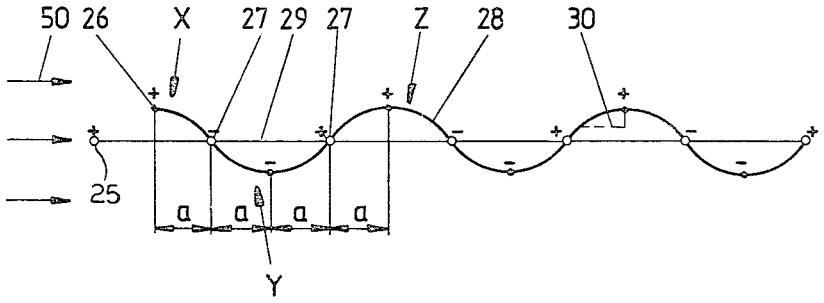
FIG. 8 is a diagram of an embodiment of the invention illustrating concentrations of positive and negative ions with reference to the timing of variations in the field strength in a series of stages.

FIG. 8 shows another embodiment of the invention in highly diagrammatic form, the form path being provided with alternating thick wires 25 and thin wires 26 spaced apart by distance a in the flow direction.

Electrically and in pairs, each thick and thin wire is provided at the same potential (FIG. 9) being connected to the same side of a high voltage alternating current source 32. In this case, the counterelectrode 27 for preceding stage in the direction of arrows 50 forms the auxiliary electrode of the subsequent stage, a series of stages being represented at X,Y and Z.

In this embodiment, the ions move only in the direction indicated by the arrows 50 and thus entrain air therewith in the manner previously described. For each stage, the thin wire 26 constitutes the discharge electrode generating the ions while the preceding thick electrode 25 or 27 constitutes the auxiliary electrode while the succeeding thick electrode 27 constitutes the counterelectrode of opposite polarity.

The discharge electrodes 26 alternate in polarity and thus alternatingly generate positive and negative ions. The line 28, having the configuration of a sine curve, represents somewhat diagrammatically the concentrations of positive ions (above the axis 29) and the concentration of negative ions (below the axis 29) after long-term operation, the wave moving to the right as represented at 30 with generation of new ions at each polarity reversal of the source.

Figure 9:
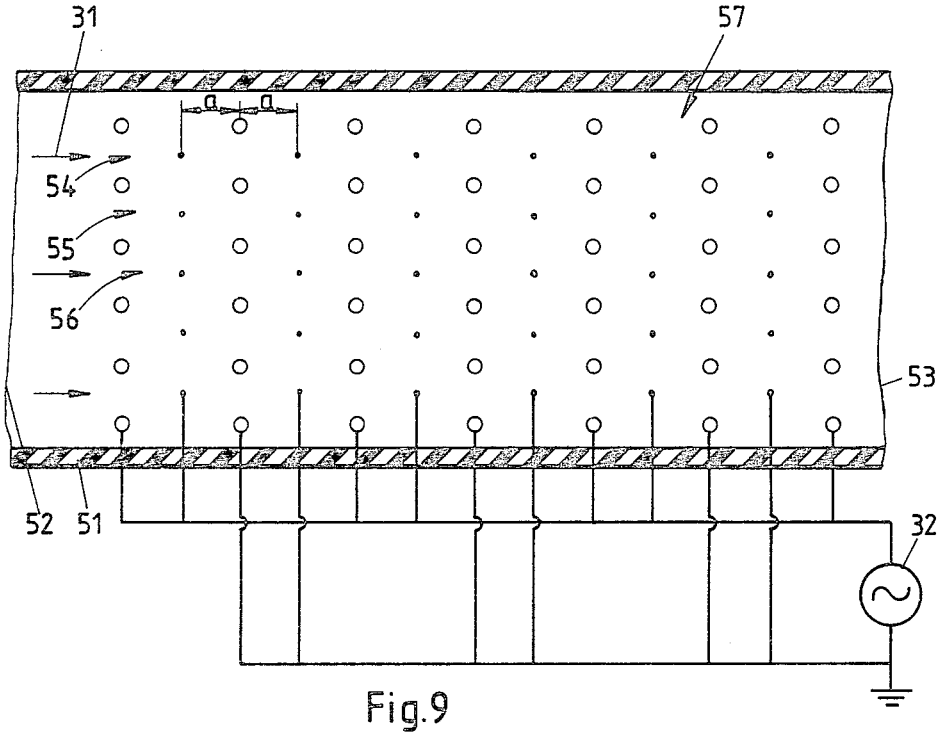
FIG. 9 is a diagram illustrating the electrode wire arrangements for this embodiment.

FIG. 9 shows that a blower of the type illustrated in FIG. 8 can comprise a duct 51 having an inlet 52 and an outlet 53 and, within this duct, a plurality of paths 54, 55, 56, etc. formed by the array 57 of wires, each path being constituted.

In projection upon the flow direction 31, all of the wires have the same spacing a. When a is given in centimeters, the alternating current frequency f in Hertz, the flow velocity of the gas will be $V=4$ af.

When the drift velocity of the ions in the gas differs from the flow velocity thereof sharply in the same coordinate system V naturally will represent the drift velocity.

This is not the same for all ions since the ions are picked up by various particles, they can be hydrated to different degrees or can be absorbed by dust particles. As a consequence, the velocity V will represent a mean drift velocity.

I claim:

1. In an apparatus wherein charged particles are generated by a discharge electrode and are collected on a plurality of spaced-apart collector plates at a potential different from that of said discharge electrode, the improvement which comprises intermediate collector plates not connected to any voltage source and disposed between but insulated from the first-mentioned collector plates and positioned in the electric field between said first collector plates and said discharge electrode to have induced on said intermediate collector plates potentials between those of said first collector plates and said discharge electrode.

2. The improvement defined in claim 1, further comprising nozzle means for generating an aerosol of a vaporizable or nonvolatile liquid to form said particles.

3. The improvement defined in claim 1, further comprising means forming a spark gap for stabilizing the potential on said intermediate plates.

4. The improvement defined in claim 1 wherein said discharge electrode is at ground potential and said first collector plates are at a high potential.

5. The improvement defined in claim 4 wherein said intermediate plates are spaced from said discharge electrode by a greater distance than said first collector plates.

6. The improvement defined in claim 5, further comprising stabilizing means forming a spark gap between said first and intermediate collector plates.

7. An apparatus for generating a directed stream of a gas, comprising:

means forming a duct having an inlet side and an outlet side;

at least one discharge electrode in said duct for producing ions therein;

a counterelectrode spaced in said duct from said discharge electrode toward said outlet side, said electrode being positioned and energized to establish a potential field between them and generate a glow discharge at said discharge electrode with a discharge current between substantially $10^{-6}$ A/cm$^2$ and $10^{-1}$ A/cm$^2$, said counterelectrode having guide surfaces for air traversing said duct having edges parallel to the discharge electrode and disposed such that ions are emitted from said discharge electrode over an apex angle of less than 180° whereby an ion drift between said discharge electrode and said counterelectrode displaces said gas through said duct; and an auxiliary electrode spaced from said discharge electrode toward said inlet side and of the same polarity as said discharge electrode, said auxiliary electrode having edges parallel to said discharge electrode.

8. The apparatus defined in claim 7 wherein said auxiliary electrode comprises at least one plate, said discharge electrode comprises at least one wire, and said counterelectrode comprises a plurality of plates, said discharge electrode and said auxiliary electrode being at a high potential, said counterelectrode being grounded.

9. The apparatus defined in claim 7 wherein said auxiliary electrode, said counterelectrode and said discharge electrode are all constituted as wires, said auxiliary electrode and said counterelectrode each being of greater diameter than said discharge electrode.

10. The apparatus defined in claim 7 wherein said counterelectrode is at high potential and said auxiliary electrode and said discharge electrode are at substantially ground potential.

11. The apparatus defined in claim 10 wherein said discharge electrode is formed as a resistance wire or strip.

12. The apparatus defined in claim 7 wherein said auxiliary electrode, said discharge electrode and counterelectrode form a gas displacement stage, a plurality of such stages being provided in succession in said duct.

13. The apparatus defined in claim 7 wherein said auxiliary electrode, said discharge electrode and said counterelectrode form a gas-displacing stage in said duct, said duct being provided with a plurality of such stages, said apparatus further comprising a source of alternating current at high potential for energizing jointly the auxiliary and discharge electrodes of all of said stages and the counterelectrode of all of said stages, the electrodes of said stages being spaced apart whereby the lesser of the drift velocity of said ions and the drift velocity of the gas displaced thereby is equal at least to several times the product of the frequency of the alternating current and the electrode spacing.

14. The apparatus defined in claim 13 wherein each auxiliary electrode and counterelectrode is a relatively thick wire and each discharge electrode is a relatively thin wire, each counterelectrode forming an auxiliary electrode of a succeeding stage.

15. An apparatus for generating a directed stream of a gas, comprising:

means forming a duct having an inlet side and an outlet side;

at least one discharge electrode in said duct for producing ions therein;

a counterelectrode spaced in said duct from said discharge electrode toward said outlet side, said electrode being positioned and energized to establish a potential field between them and generate a glow discharge at said discharge electrode with a discharge current between substantially $10^{-6}$ A/cm$^2$ and $10^{-1}$ A/cm$^2$, said counterelectrode having guide surfaces for air traversing said duct having edges parallel to the discharge electrode and disposed such that ions are emitted from said discharge electrode over an apex angle of less than 180° whereby an ion drift between said discharge electrode and said counterelectrode displaces said gas through said duct; and nozzle means for spraying an aerosol of a liquid into said duct whereby droplets of said aerosol receive electrical charge from said ions and drift toward said counterelectrode, said nozzle means having a conical spray pattern with an apex angle less than 90°, said aerosol passing along a path of at least 20 mm and being subjected along said path to a potential difference between substantially 10 and 30 kV.

16. The apparatus defined in claim 15, wherein said nozzle means is substantially at ground potential and said counterelectrode is at a high potential.

* * * * *